United States Patent [19]

Lewyllie et al.

[11] Patent Number: 4,967,807

[45] Date of Patent: Nov. 6, 1990

[54] SYSTEM FOR THREADING LOOM JET NOZZLE WITH CORRECT LENGTH OF THE WEFT THREAD

[75] Inventors: Dirk Lewyllie, Wervik; José Vangheluwe, Ieper, both of Belgium

[73] Assignee: Picanol N.V., Belgium

[21] Appl. No.: 360,536

[22] Filed: Jun. 2, 1989

[30] Foreign Application Priority Data

Jun. 2, 1988 [BE] Belgium ..... 08800621

[51] Int. Cl.[5] ..... D03D 47/30; D03D 47/36

[52] U.S. Cl. ..... 139/452; 139/435.1; 139/194

[58] Field of Search ..... 139/116.1, 452, 435.1, 139/194, 453, 430, 263, 116.2

[56] References Cited

U.S. PATENT DOCUMENTS

| | | | |
|---|---|---|---|
| 4,620,570 | 11/1986 | Suzuki | 139/116 A |
| 4,658,866 | 4/1987 | Takegawa | 139/452 |
| 4,781,221 | 11/1988 | Onishi et al. | 139/452 |

FOREIGN PATENT DOCUMENTS

| | | |
|---|---|---|
| 900438 | 2/1985 | Belgium . |
| 0075757 | 4/1983 | European Pat. Off. . |
| 0216220 | 4/1987 | European Pat. Off. . |
| 8602191 | 3/1988 | Netherlands . |
| 1150077 | 4/1969 | United Kingdom . |

*Primary Examiner*—Andrew M. Falik

*Attorney, Agent, or Firm*—Bacon & Thomas

[57] ABSTRACT

A method of threading a weft insertion jet nozzle so that a correct length of the leading end of the weft thread extends from the jet nozzle in the direction of the shed includes the steps of bringing a weft thread into its corresponding jet nozzle, inserting at least one weft length of said weft thread into the shed, cutting off the length of weft thread which has been inserted into the shed so that the correct length of weft thread extends from the outlet of the jet nozzle, and finally removing the cut-off length of weft thread from the shed. A weaving machine adapted for carrying out the described method includes a control unit connected to the weaving machine's prewinders, jet nozzles, a suction nozzle, a cutter, and to the drive of the sley of the weaving machine.

13 Claims, 3 Drawing Sheets

SYSTEM FOR THREADING LOOM JET NOZZLE WITH CORRECT LENGTH OF THE WEFT THREAD

BACKGROUND OF THE INVENTION

1. Field of the Invention

This invention concerns a method for threading jet nozzles of weaving machines with a correct length of the weft thread end, and also a weaving machine which uses this method.

The invention is intended in the first place for threading the main nozzles of airjet weaving machines with a correct length of the weft thread end. More generally, however, it can be used in all weaving machines in which the weft threads are inserted into the shed via a jet nozzle by means of a fluid, for example, in weaving machines in which the fluid consists of a liquid, such as water.

2. Description of Related Art

As is known, in airjet weaving machines the weft threads are wound off from yarn packages by means of prewinders, while weft thread lengths are taken one by one from these prewinders and inserted into the shed by means of one or more main nozzles. Whenever a break in the supply of a weft thread occurs, or whenever it is necessary to work with another weft thread, rethreading of the corresponding main nozzle can be done either manually or automatically.

When a weft thread is threaded into the main nozzle manually, the weaver presents the leading end of the thread to the intake of the main nozzle, and then by pressing a pushbutton releases one turn of weft thread from the prewinder. The weft thread is then sucked up by the activated main nozzle. When threading is carried out automatically, the weft thread is presented to the main nozzle automatically, and a number of turns are released automatically, until the leading end of the weft thread reaches at least through the main nozzle.

Clearly, the free end of the weft thread which is brought in will in most cases not be situated precisely at the front end of the main nozzle, but will reach out of the main nozzle. As is known, problems result if the thread end reaching out of the main nozzle is not removed, either because the free thread end may be unintentionally woven into the cloth or because the free thread end makes inserting the next weft thread more difficult. Until now, it has been customary for the weaver to cut off the free thread end after rethreading of the main nozzle. However, since the goal is full automation of weaving machines, manual interventions should clearly be capped to a minimum.

SUMMARY OF THE INVENTION

A purpose of present invention is to provide a method for bringing a weft thread into a jet nozzle, such as a main nozzle, which does not have the above-mentioned disadvantage, i.e. a correct length of the weft thread end is provided automatically.

To this end, the includes the steps of bringing a weft thread into the jet nozzle, preferably automatically; inserting at least one weft length of this weft thread into the shed; and leaving the correct length in the main nozzle by cutting off said inserted length of weft thread at the outlet of the corresponding jet nozzle and removing it from the shed.

The method can be implemented on existing machines, provided they are fitted with a suitable control unit. The invention also concerns weaving machines which use the above-mentioned method.

BRIEF DESCRIPTION OF THE DRAWINGS

In order to better explain the characteristics of the invention, the following preferred embodiments are described, by way of example only and without being limitative in any way, with reference to the accompanying drawings, where.

DESCRIPTION OF THE PREFERRED EMBODIMENTS

Figure 1:
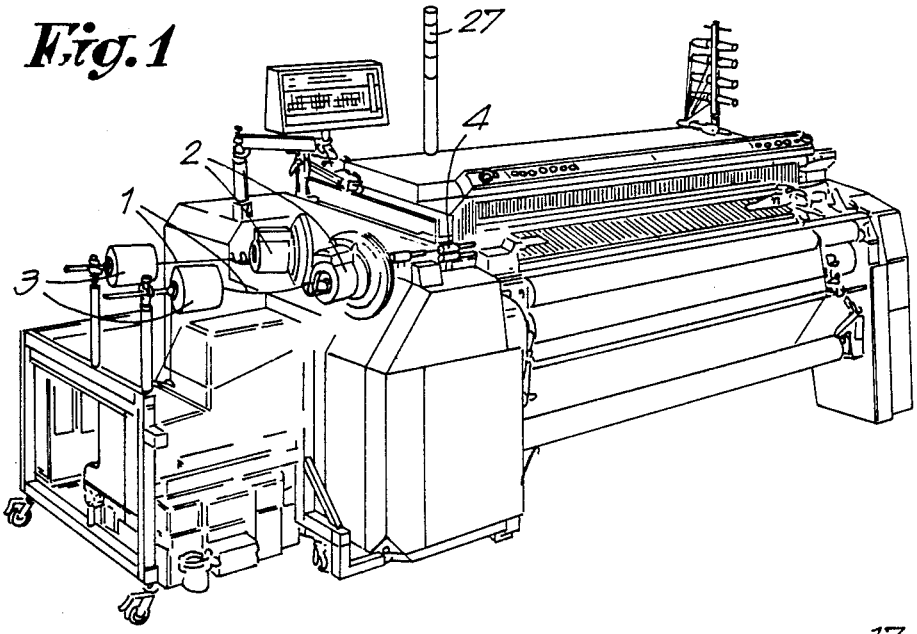
FIG. 1 is a perspective view of an airjet weaving machine.

As shown in FIG. 1, it is known that on airjet weaving machines the weft threads 1 are unwound by means of thread preparation devices, such as prewinders 2, from yarn packages 3, after which they are led to the jet nozzles, in this case the main nozzles 4.

Figure 2:
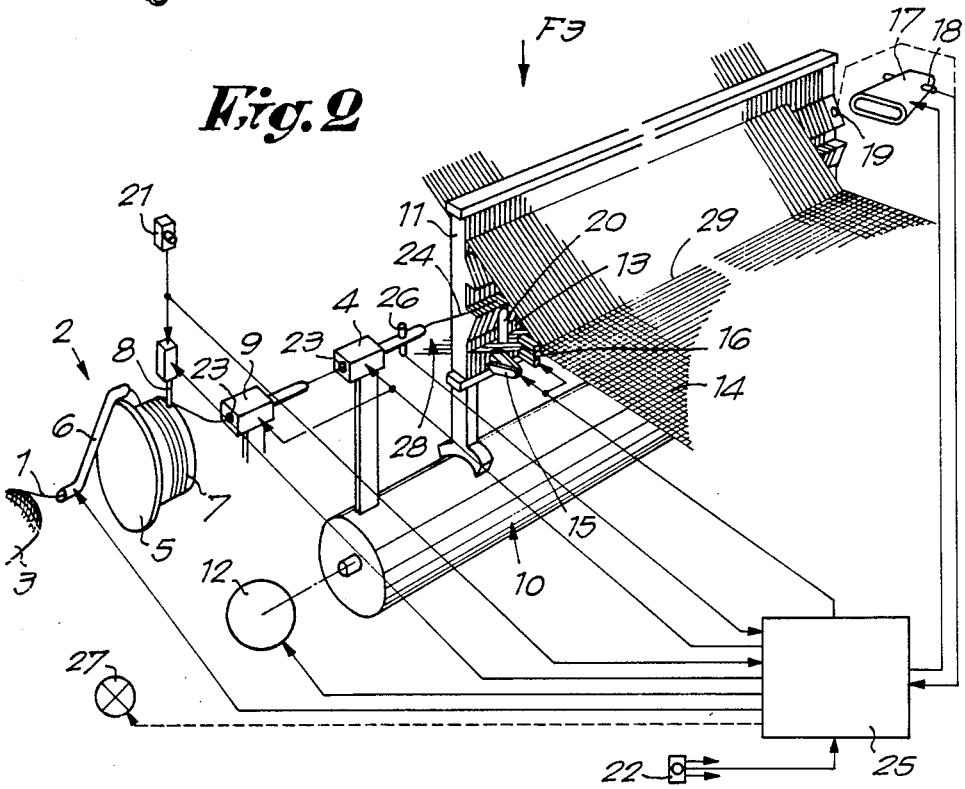
FIG. 2 shows schematically the parts of the weaving machine required for implementation of the method according to the invention.

This process is further illustrated in the schematic configuration in FIG. 2, showing only one thread supply mechanism. Said prewinder 2 consists as is known of a fixed prewinder drum 5 and a rotatable winding tube 6, where the turns 7 wound on the prewinder drum 5 are held on by a magnetically-operated pin 8.

Also shown in FIG. 2 are an auxiliary main nozzle 9, the sley 10 with the reed 11, the sley drive 12, the shed 13, the cloth 14, a weft cutter 15, a thread clip 16, a suction nozzle 17 situated opposite the main nozzle 4, a thread detector 18 which operates in conjunction with the suction nozzle 17, a weft detector 19 mounted on the reed 11, the relay nozzles 20, a pushbutton unit 21 for manual control of the above-mentioned pin 8, and the start button 22 of the weaving machine. All these components are common technology. In this embodiment, the prewinder 2, the yarn packages 3, the auxiliary main nozzle 9, the weft cutter 15, the thread clip 16 and the suction nozzle 17 are all fixedly mounted on the frame of the weaving machine.

When the main nozzle 4 and the auxiliary main nozzle 9, if there is one, have to be threaded with weft thread 1, the weaver presents the leading end of the corresponding weft thread 1 to the intakes 23 of nozzles 9 and 4 while they are activated. He then operates the pushbutton unit 21 so that one turn is released and a section of weft thread 1 is led through the nozzles 9 and 4. Clearly, the turn released will not correspond exactly to the required length of weft thread 1, i.e. after threading there will always be a free thread end 24 reaching out of the main nozzle 4. Such a free end can cause problems when the next weft thread is inserted into the shed 13, either because the free thread end may be unintentionally woven into the cloth, or because the free thread end makes inserting the next weft thread more difficult. It is therefore customary for the weaver to cut off the thread end 24 with a pair of scissors.

The present invention provides a method by which the correct length of weft thread end is automatically obtained in the main nozzle 4. As shown in FIG. 2, for this purpose the weaving machine is equipped with a control unit 25 which controls the above-mentioned components of the weaving machine in such a way that the method described below is carried out automatically.

According to the method of the invention, a check is first carried out to ensure that the main nozzle 4 has been rethreaded. In the case that the main nozzle 4 is provided with thread automatically, the start signal from the automatic repair unit can be used as a basic datum to indicate that rethreading has been carried out. A detector 26 in the thread channel of the main nozzle 4 confirms that rethreading has been carried out. From the moment that the detector 26 gives a signal, the method according to the invention, as described below, can be carried out in order for the resulting thread end 24 to be removed.

If the main nozzle 4 is rethreaded manually, the weaver operates the pushbutton unit 21 at least once. This signal can be used as a datum to indicate that the main nozzle 4 has been threaded with weft thread 1 once more.

Another possibility is for there to be a special pushbutton which the weaver has to press once rethreading has been carried out.

The above-mentioned signals are sent to the control unit 25, so resulting in a data item from which the control unit 25 can deduce whether or not rethreading has been carried out.

When the start button 22 of the weaving machine is then pressed after the main nozzle 4 has been rethreaded, the weaving machine will not start immediately; instead, the control unit 25 first automatically carries out the method according to the invention. By means of a signalling device 27 a signal can be given to warn the weaver that the method for removing the thread end 24 is in progress.

Figure 3:
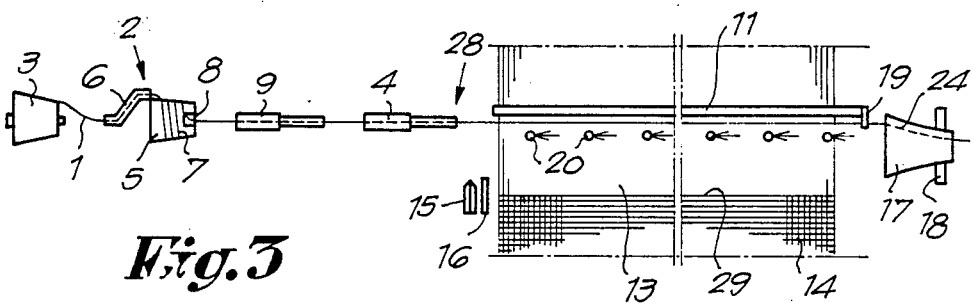
FIGS. 3 to 5 are schematic views in the direction of the arrow F3 in FIG. 2, for different steps of the method.

In the first step, the shed 13 is opened. The weft cutter 15 and the thread clip 16 are brought into the open position. Then, as shown in FIG. 3, a length of weft thread 1 is inserted into the shed 13, at least until the free end 24 of this thread reaches into the suction nozzle 17. Inserting this length of weft thread can be done in the conventional way by means of the main nozzle 4 and the relay nozzles 20. Inserting the exact length can be done either by releasing a certain number of turns 7 from the prewinder drum 5, or by leaving the pin 8 of the prewinder 2 open until a weft thread 1 is detected near the suction nozzle 17, for example by means of a detector 19 mounted on the reed 11, or by means of the detector 18 mounted in the suction nozzle 17.

Here it should be noted that if as shown in the figures the cloth 14 being woven is narrower than the full weaving width of the weaving machine, the length of weft thread 1 inserted must be longer than the weft length or the width of the cloth, in order to make sure that the thread end 24 reaches into the suction nozzle 17 which is fixedly mounted on the frame of the weaving machine.

Clearly, if the width of cloth 14 being woven is the same as the full weaving width of the weaving machine, or if the suction nozzle 17 is movably mounted so that it is always positioned immediately next to the cloth 14, for example by being slide-mounted on the sley, it is sufficient for the length of weft thread 1 being inserted to be equal to the normal weft length, i.e. equal to the width of the cloth.

Figure 4:
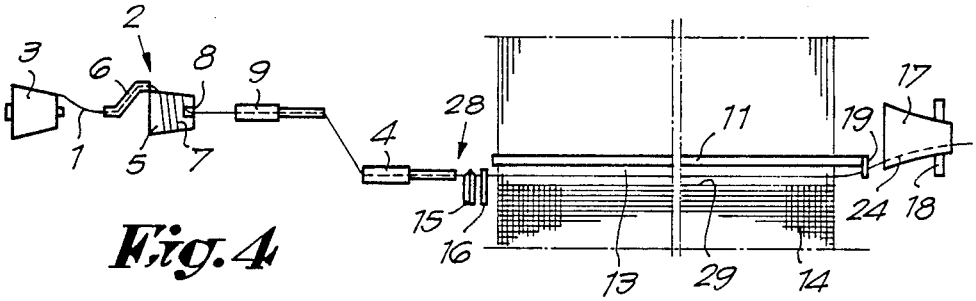

In the second step of the method, the length of weft thread led through the shed 13 is cut off just after the outlet 28 of the main nozzle 4. As shown in FIG. 4, this can be done by commanding the sley 10 such that the reed 11 moves a certain distance forward, so that said weft thread 1 comes up to the fell line 29. The movement of the sley 10 is stopped in time so that the weft thread 1 is not beaten up against the fell line 29. However, the movement is far enough for the weft thread to be brought into the opened cutter 15 and the clip 16. By means of the electrically-operated cutter 15, the clip 16 which operates in conjunction with said cutter is closed and the weft thread 1 is cut off just in front of the outlet 28 of the main nozzle 4.

In the third step, the length of weft thread 1 cut off is removed from the shed 13, so that finally the main nozzle 4 is left with just the right length of weft thread 1, after which the weaving process can be started.

Figure 5:
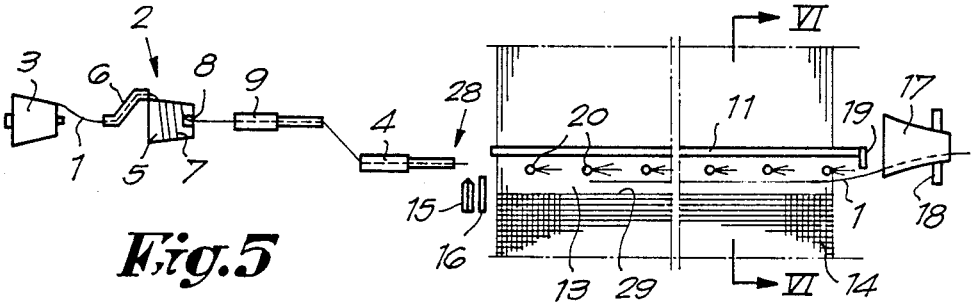
Figure 6:
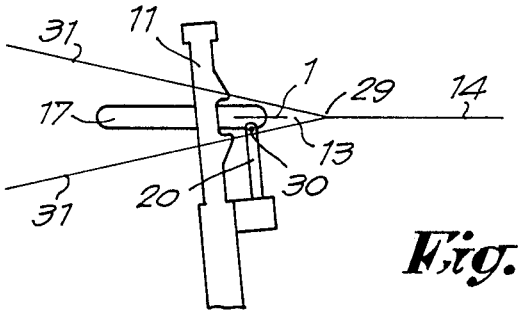
FIG. 6 is a cross-section along line VI—VI in FIG. 5.

As shown in FIGS. 5 and 6, removing the length of the weft thread 1 after it has been been cut off is preferably done by moving the sley 10 part way back until the outlets 30 of the relay nozzles 20 just reach into the shed 13, whereupon they are activated. As a result of the blowing force of the relay nozzles 20 and the pulling force of the suction nozzle 17 the length of weft thread 1 which has been cut off is easily removed from the shed 13.

Clearly, after the method according to the invention has been carried out, the weaving machine can start automatically.

The method according to the invention can be implemented on any existing weaving machine, provided it is equipped with a suitable control unit 25.

In addition, it will be appreciated by those skilled in the art that the method according to the invention can also be implemented using means specially intended for this purpose. Thus, for example, cutting the length of weft thread 1 inserted can be done by means of a cutter provided specially for this purpose rather than by means of the above-mentioned weft cutter 15. Also, special means other than nozzle 17 for removing the thread can be used in order to remove the cut-off length of weft thread 1 from the shed 13.

If two or more jet nozzles, such as main nozzles 4, have to be rethreaded at the same time, the method according to the invention is carried out simultaneously for all the corresponding weft threads. This means that two or more threads are led through the shed 13 and are then cut off simultaneously. The reason for this is that if just one thread were inserted first, then when this thread were cut off the end 24 of the other weft thread would also-be cut off, so that it would be possible for the other end 24 to be subsequently blown into the shed 13 and become entangled in the warp threads 31, causing a weaving fault.

Figure 7:
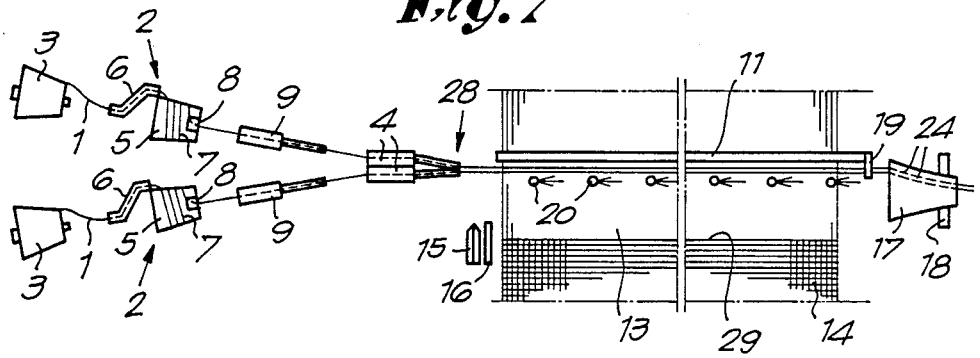
FIGS. 7 to 9 illustrate schematically the method according to the invention, for threading two jet nozzles.
Figure 8:
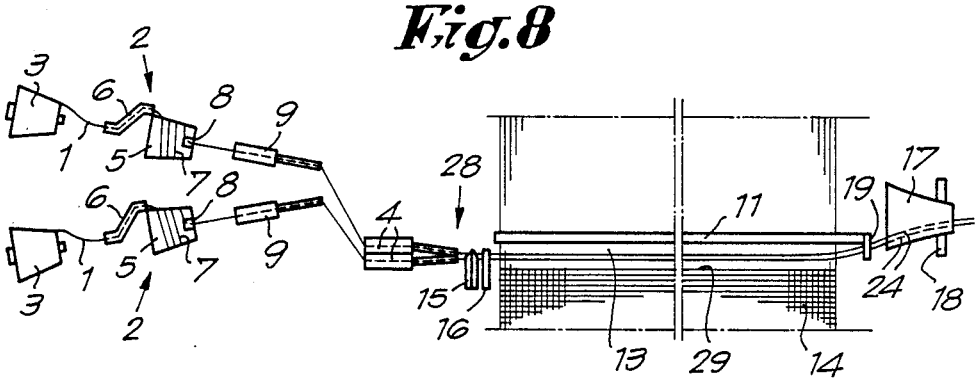
Figure 9:
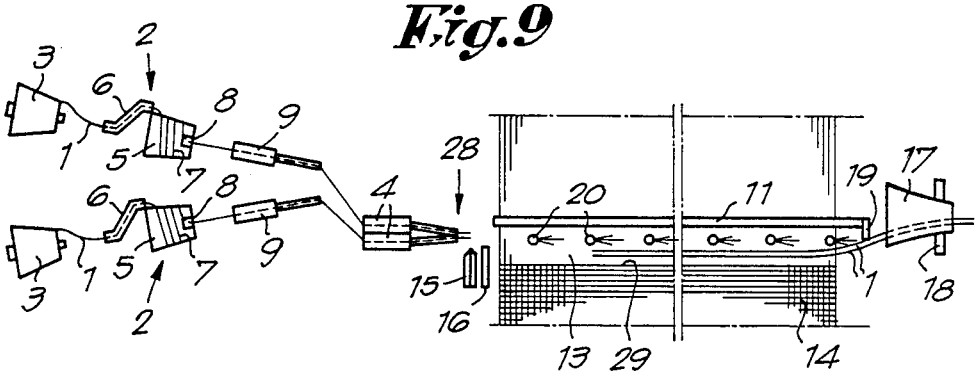

For the sake of illustration, FIGS. 7 to 9 show the same steps of the method according to the invention as in FIGS. 3 to 5, but with two main nozzles 4 being supplied with a correct length of the weft thread end simultaneously.

Although the invention is described using an airjet weaving machine as an example, the invention clearly can also be applied to weaving machines in which the transport medium consists of a fluid other than air.

The present invention is not limited to the embodiments described by way of example and shown in the figures; on the contrary, such a method for supplying a correct length of the weft thread end into the jet nozzles of weaving machines, and weaving machines which use this method, can be made in different variants, while still remaining within the scope of this invention.

We claim:

1. A method for threading weft insertion jet nozzles in a weaving machine such that a correct length of weft thread end extends from the jet nozzles in the direction of the shed, comprising the steps of: successively bringing a weft thread into a corresponding jet nozzle; inserting at least one weft length of said weft thread into the shed; cutting off at the outlet of the corresponding jet nozzle the length of weft thread which has been inserted into the shed, thereby leaving a correct length of weft thread and extending from said corresponding jet nozzle; and finally removing the cut-off length of weft thread from the shed.

2. A method as claimed in claim 1, wherein, before the step of cutting off the inserted length of weft thread, an end of said inserted length of weft thread is taken up by a suction nozzle located on the side of the shed opposite the jet nozzle, thereby removing slack in said inserted length of weft thread, and wherein, after step of cutting off the length of weft thread, the step of removing the cut-off length of weft thread is carried out by said suction nozzle.

3. A method as claimed in claim 2, further comprising the step of monitoring the insertion of said weft thread by means of a detector located in said suction nozzle.

4. A method as claimed in claim 2, wherein said weaving machine is an air jet weaving machine in which the jet nozzles are main nozzles and the step of inserting said at least one length of weft thread into the shed is carried out by activating at least the corresponding main nozzle and a plurality of relay nozzles, and wherein said step of removing the cut-off length of weft thread from the shed is carried out by activating both the relay nozzles and the suction nozzle.

5. A method as claimed in claim 1, wherein said weaving machine is an air jet weaving machine and said jet nozzles are main nozzles, and wherein said step of inserting at least one weft length into the shed is carried out by activating at least the corresponding main nozzle and a plurality of relay nozzles.

6. A method as claimed in claim 5, wherein said step of removing the cut-off length of weft thread from the shed includes the steps of moving the sley of the weaving machine until the outlets of the relay nozzles just reach into the shed, and subsequently activating said relay nozzles to remove said cut-off length of weft thread from the shed.

7. A method as claimed in claim 1, further comprising the step of monitoring the insertion of said length of weft thread by means of a detector located on the side of the shed opposite the jet nozzles at a position corresponding to the weaving width.

8. A method as claimed in claim 1, further comprising the step of monitoring the insertion of said weft thread by means of a detector which is located at an end of a reed opposite the jet nozzles, said detector being arranged to move with said reed.

9. A method as claimed in claim 1, wherein said step of cutting off said length of weft thread at the outlet of a jet nozzle includes the steps of moving the sley of the weaving machine until the inserted length of weft thread is located within range of a weft cutter, and subsequently operating said weft cutter to cut off said length of weft thread.

10. A method as claimed in claim 1, wherein the weaving machine is an air jet weaving machine in which the jet nozzles are main nozzles, and further comprising the step of bringing the weft thread into a corresponding main nozzle by leading said weft thread to the main nozzle while the main nozzle is activated.

11. A method for threading jet nozzles in a weaving machine, a plurality of said jet nozzles having to be rethreaded at once, such that a correct length of weft thread and extends from each of the plurality of jet nozzles in the direction of the shed, comprising the steps of: bringing the respective weft threads into the corresponding jet nozzles and inserting all of the weft threads into the shed; simultaneously cutting off at the respective outlets of the corresponding jet nozzles the different inserted weft threads, thereby leaving a correct length of weft thread end extending from each of the corresponding jet nozzles; and finally removing the cut-off lengths of weft thread from the shed.

12. In a weaving machine having a shed, prewinders, jet nozzles including main nozzles, a suction nozzle located on a side of the shed opposite the main nozzles, a cutter positioned between the main nozzles and the shed, means for driving a sley of the weaving machine, and a control unit connected to at least the prewinders, jet nozzles, suction nozzle, cutters, and sley drive means, the improvement comprising:

means for deducing whether or not a thread has been brought into a main nozzle in response to signals which indicate that the thread as been brought into the main nozzle;

means for causing a prewinder to release at least one length of weft thread;

means for controlling at least said jet nozzle to insert said at least one length of weft thread until the length of weft thread reaches into the suction nozzle;

means for deducing whether or not said length of weft thread has reached said suction nozzle in response to signals from detectors which monitor insertion of said length of weft thread;

means for controlling the drive of the sley of the weaving machine to move the sley of the weaving machine;

means for controlling the cutter to cut off the length of weft threads inserted by the jet nozzle control means; and means for controlling the suction nozzle to remove the cut-off length of weft thread from the shed.

13. The improvement as claimed in claim 12, wherein said weaving machine is an airjet weaving machine.

* * * * *